US006312343B1

(12) United States Patent
Cho

(10) Patent No.: US 6,312,343 B1
(45) Date of Patent: Nov. 6, 2001

(54) PORTABLE NET DEVICE

(76) Inventor: Kwang H. Cho, 148 S. Gramercy Pl. #16, Los Angeles, CA (US) 90004

( * ) Notice: Subject to any disclaimer, the term of this patent is extended or adjusted under 35 U.S.C. 154(b) by 0 days.

(21) Appl. No.: 09/449,462

(22) Filed: Nov. 27, 1999

(51) Int. Cl.[7] ..... A63B 69/36
(52) U.S. Cl. ..... 473/197; 273/400
(58) Field of Search ..... 473/197, 478; 273/398–401

(56) References Cited

U.S. PATENT DOCUMENTS

| | | | | |
|---|---|---|---|---|
| 3,918,711 | * | 11/1975 | Zak | 473/197 |
| 4,373,734 | | 2/1983 | Frank | 273/411 |
| 4,858,634 | | 8/1989 | McLeese | 135/104 |
| 4,905,996 | | 3/1990 | Tallent et al. | 273/26 A |
| 5,163,461 | | 11/1992 | Ivanovich et al. | 135/104 |
| 5,244,213 | | 9/1993 | Armell | 273/400 |
| 5,246,229 | | 9/1993 | Carey | 273/127 |
| 5,277,430 | | 1/1994 | Naccarato | 273/400 |
| 5,346,227 | | 9/1994 | Amram et al. | 273/400 |
| 5,427,381 | | 6/1995 | Macaluso et al. | 273/400 |
| 5,569,094 | | 10/1996 | Macaluso | 473/197 |
| 5,842,940 | | 12/1998 | Macaluso | 473/478 |
| 5,976,023 | | 11/1999 | Cho | 473/197 |

* cited by examiner

*Primary Examiner*—Mark S. Graham
(74) *Attorney, Agent, or Firm*—John K. Park; Park & Sutton LLP

(57) ABSTRACT

A portable net device for stopping the flight of projectiles such as golf balls comprises a coilable main member and a coilable base member respectively formed in closed loops, a main sleeve substantially covering the coilable main member wherein the main sleeve has a top hole and a main node cross-opposing the top hole, a fabric portion radially extending from the main sleeve for flexibly stopping the flight of projectiles such as golf balls, a base sleeve substantially covering the coilable base member wherein the base sleeve has a bottom hole and a base node cross-opposing the bottom hole, and a means for supporting the main member at a substantially erected position.

20 Claims, 7 Drawing Sheets

PORTABLE NET DEVICE

BACKGROUND OF THE INVENTION

This present invention relates to a net device. More specifically, this present invention relates to an improved portable net device which enhances portability and efficiently stops the flight of golf balls.

Various sports such as golf involve hitting or throwing projectiles such as golf balls toward a desired direction in a field. For practice purposes, it is desirable to capture the ball before it travels a large distance or strikes objects or people. Existing capturing structures include a net attached to the perimeter of a capturing frame and a rigid support frame attached to the capturing frame. The support frame is attached to the capturing frame and provides a base allowing the capturing structure to be disposed on the ground.

A disadvantage of such structure is that they cannot be easily folded and efficiently stored. This is because both the support frame and the capturing frame must be properly folded and placed in a container. Further use of a capturing frame and a supporting frame makes such structures more expensive to manufacture and harder to carry due to increased weight.

There is, therefore, a need for a golf net device which can be easily folded and efficiently stored in a container. There is also a need for such a golf net to be easy to assemble and easy to carry. Preferably, such a golf net device should be easy to manufacture by using fewer parts, light in weight and less expensive.

SUMMARY OF THE INVENTION

The present invention is contrived to overcome the conventional disadvantages. Accordingly, it is an object of the present invention to provide a portable net device which facilitates assembly and disassembly by simplifying the construction.

Another object of the present invention is to provide a portable net device which enhances portability by adopting a pair of coilable members.

To achieve the above-described objects and other objects, the portable net device according to the present invention efficiently stops the flight of projectiles such as golf balls. The portable net device comprises a coilable main member forming a first closed loop, and a main sleeve substantially covering the coilable main member. In an embodiment, the main sleeve has a top hole and a main node cross-opposing the top hole.

The net device further comprises a fabric portion radially extending from the main sleeve for flexibly stopping the flight of projectiles such as golf balls. There is also provided a coilable base member forming a second closed loop. The coilable base member can be substantially covered by a base sleeve. Here, the base sleeve has a bottom hole and a base node cross-opposing the bottom hole, wherein the main node of the main sleeve and the base node of the base sleeve are fixedly but foldably attached to each other. There is also provided a means for supporting the main member in a substantially erected but tilted position.

The support means can be formed by a support rod having an upper end and a lower end, wherein the upper end is detachably engaged in the top hole of the coilable main member and the lower end is detachably engaged in the bottom hole of the base member.

The upper end and the lower end of the support means can respectively have a protrusion extending from each tip thereof, wherein the protrusion is less in diameter than each of the upper and lower ends so as to stably support the main member and the base member.

In an improvement, the upper end and the lower end of the support means are respectively formed in a hook so as to be stably hooked into the corresponding top and bottom holes.

In an embodiment, the support means can comprise a first half, a second half, an elastic string, and a nut closure having a closed end and an open end, wherein the first half has a first inner end fixedly carried on the closed end of the nut closure and the second half has a second inner end detachably carried on the open end of the nut closure. The elastic string can be fixedly disposed through the first half and the second half of the support means so that the second half can be elastically disassembled from the first half of the support means.

The coilable main and base members can form overlapping loops by a slight manual enforcement thereon when the support means is detached from the respective coilable members for disassembly of the portable net device.

The portable net device can further comprise at least one strap having two ends, the one end attached to the main member about the top hole and the other end attached to the base member about the bottom hole, wherein the strap longitudinally covers the support means. The strap may be preferably formed of an elastic material.

Further, the portable net device may have an arc support substantially covering less than about one-third of the main sleeve so that the projectiles stopped in the fabric portion can be maintained behind the arc support. The arc support can be formed of a fabric material.

The advantages of the present invention are numerous. First, the portable net device according to the present invention substantially improves portability by simplifying its structure. Second, a pair of coilable members are foldably connected to each other, thereby further facilitating storage, assembly and disassembly of the net device. Third, an angle between the coilable members is easy to adjust using the support means, thereby enhancing usability.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
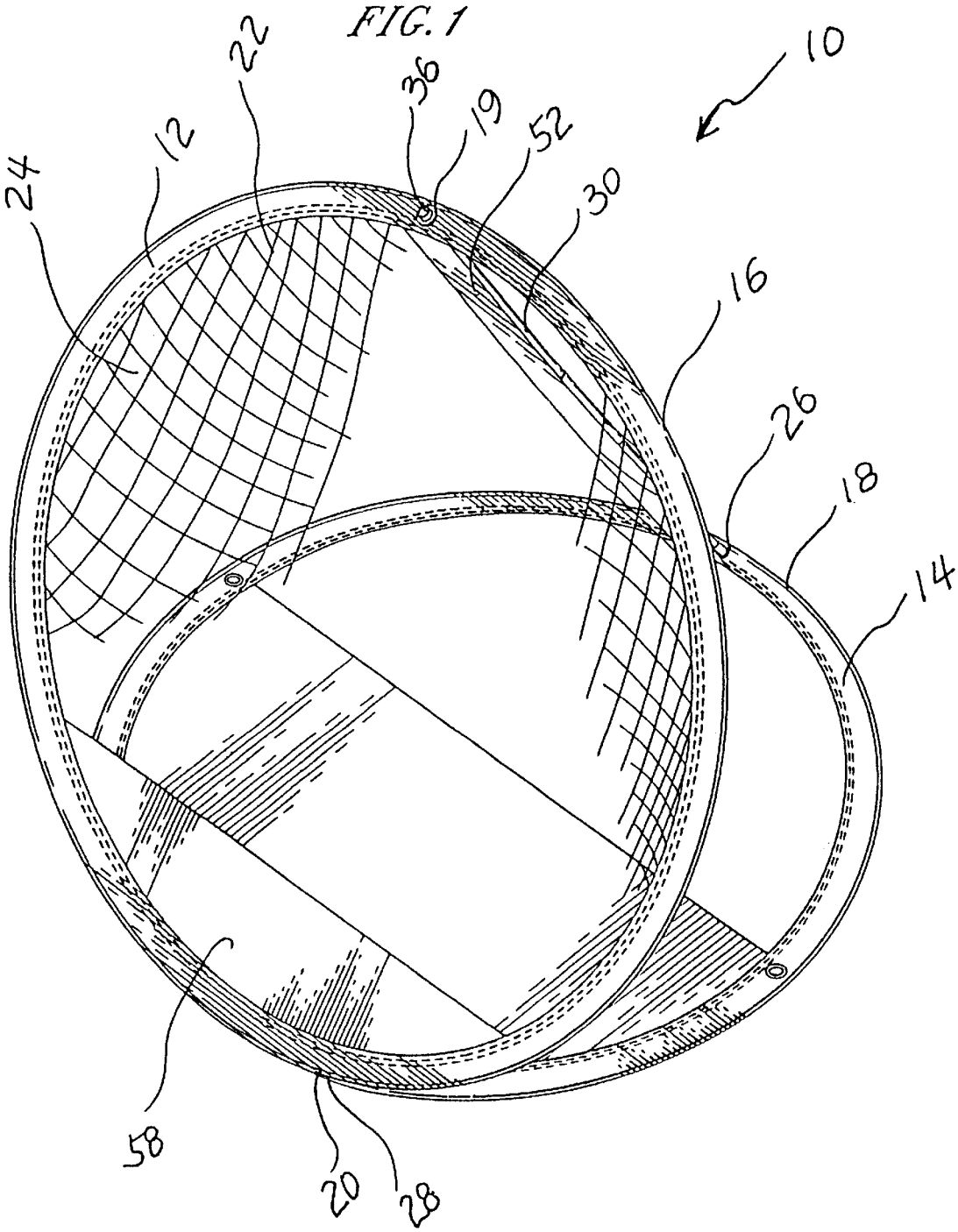
FIG. 1 is a perspective view illustrating a portable net device according to a first embodiment of the present invention.
Figure 2:
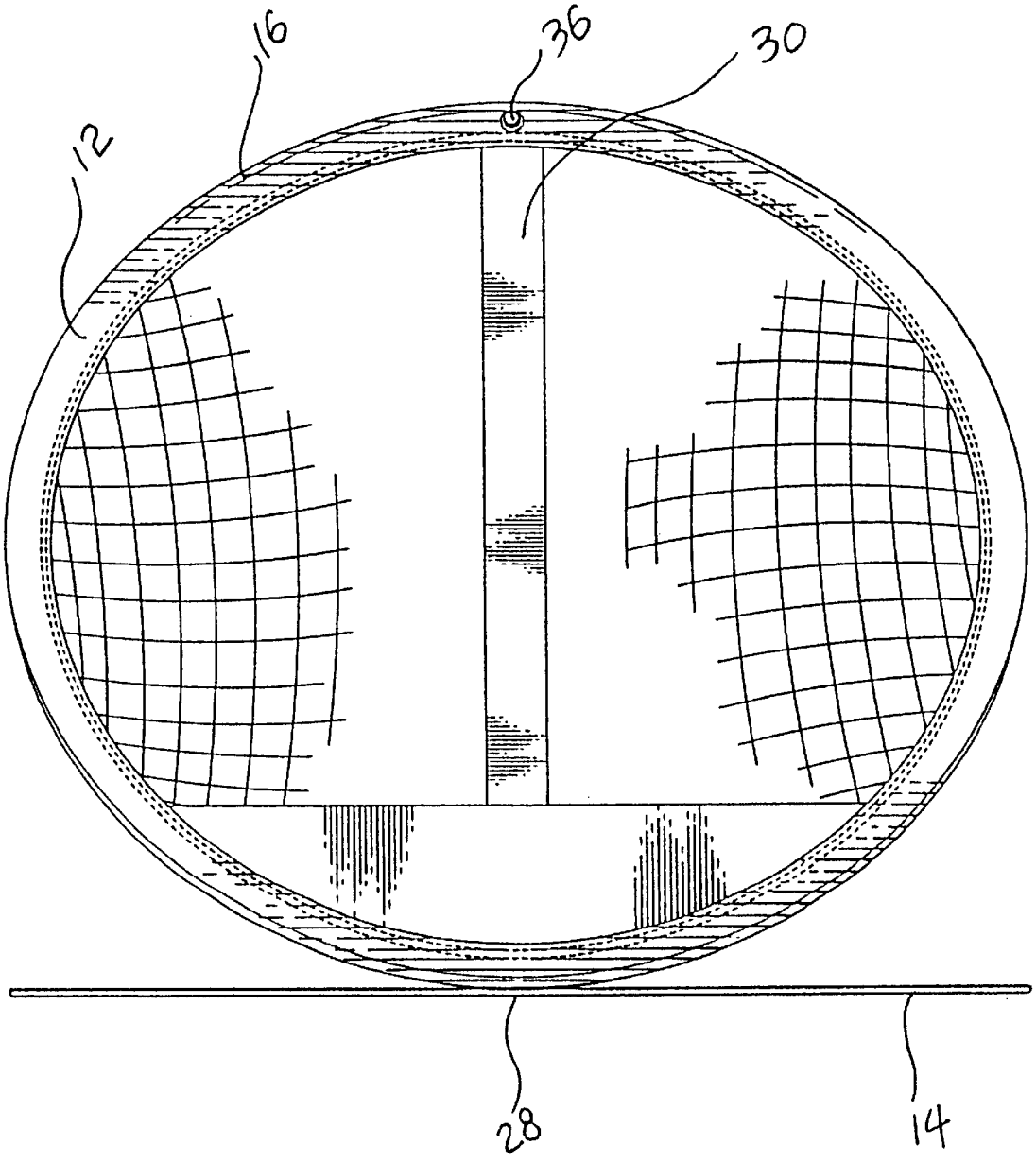
FIG. 2 is a front view of the portable net device in FIG. 1.

With reference to the accompanying drawings, a portable net device 10 according to a preferred embodiment of the present invention will now be described.

The portable net device 10 serves to stop the flight of projectiles such as golf balls. As shown in FIGS. 1 through 5, the portable net device 10 comprises a coilable main member 12 and a coilable base member 14 each of which forms a closed loop.

The coilable main member 12 is substantially covered by a main sleeve 16 and also the coilable base member 14 is substantially covered by a base sleeve 18. The respective coilable members 12, 14 may be formed of an elastic material so as to facilitate the assembly and the coiled overlapping for disassembly.

The main sleeve 16 is substantially worn on and along the coilable main member 12. The main sleeve 16 has a top hole 19 and a main node 20 cross-opposing the top hole 19 so that a distance between the top hole 19 and the main node 20 can approximately make a diameter of the circular main member 12. The base node 28 is disposed at a lowermost point of the circular main member 12.

A fabric portion 22 radially extends from the main sleeve 16 for flexibly stopping the flight of projectiles (not shown) such as golf balls. The fabric portion 22 forms a net fabrication, wherein threads are interwoven or knotted together to form a plurality of meshes 24. Here, each of the meshes 24 may be formed smaller than a regular golf ball.

The base sleeve 18 surrounds and contains the coilable base member 14 and has a bottom hole 26 and a base node 28 cross-opposing the bottom hole 26. The main node 20 of the main sleeve 16 and the base node 28 of the base sleeve 18 are fixedly but foldably attached to each other. As a result, the circular main member 12 and the circular base member 14 hingedly overlap each other at the main and base nodes 20, 28. The main node 20 and the base node 28 may be fixedly attached to each other by interweaving or sewing. Selectively, the main and base nodes 20, 28 can be connected by a hinge.

Figure 3:
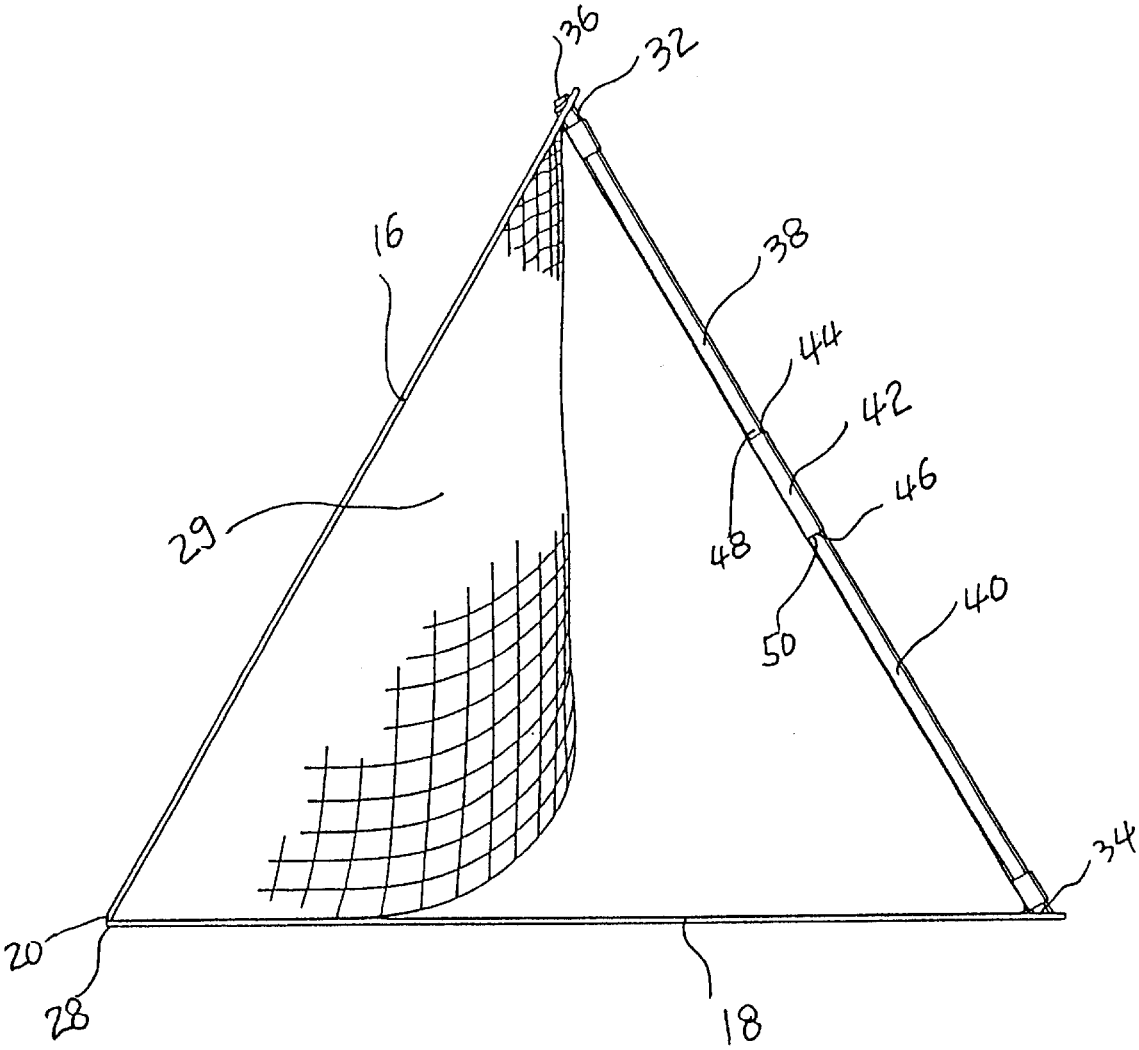
FIG. 3 is a side view of the portable net device in FIG. 1.

The main member 12 is supported by a means 30 for supporting the main member 12. The main member 12 can be disposed at a substantial angle substantially less than ninety degrees. The support means 30 maintains the main member 12 at a substantially erect but tilted position. A preferable angle of tilt is about 30 to 35 degrees, but other angles of tilt can be used. The tilt allows the fabric portion 22 to be spaced apart from the main member 12 after installation to facilitate receipt and retention of projectiles. The net space 29 formed by this tilted construction of the main member 12 is best illustrated in FIG. 3. The support means 30 may be selected from a rod, a pipe, and other commonly known support means.

The support means 30 has an upper end 32 and a lower end 34 as shown in FIG. 3. The upper end 32 is detachably engaged in the top hole 19 of the coilable main member 12 and the lower end 34 is detachably engaged in the bottom hole 26 of the base member 14. The support means 30 may be adjustable to increase or decrease an angle between the main member 12 and the base member 14.

The upper end 32 and the lower end 34 of the support means 30 respectively have a protrusion 36 extending from each tip thereof, wherein the protrusion 36 is less in diameter than each of the upper and lower ends 32, 34 so as to stably support the main member 12 and the base member 14.

For a better performance, the upper end 32 and the lower end 34 of the support means 30 are respectively formed in a hook so as to be stably hooked into the corresponding top and bottom holes 19, 26.

In further detail, the support means 30 comprises a first half 38, a second half 40, an elastic string (not shown), and a nut closure 42 having a closed end 44 and an open end 46. The first half 38 has a first inner end 48 fixedly carried on the closed end 44 of the nut closure 42 and the second half 40 has a second inner end 50 detachably carried on the open end 46 of the nut closure 42. The elastic string (not shown) is fixedly disposed through the first half 38 and the second half 40 of the support means 30 so that the second half 40 can be elastically disassembled from the first half 38 of the support means 30.

According to the first embodiment, the coilable main member 12 and the coilable base member 14 form overlapping loops by a slight manual enforcement thereon. When the support means 30 is detached from the respective coilable members 12, 14 for disassembly of the portable net device 10, the main member 12 rotates downward under the force of gravity and lies on top of the base member 14.

Figure 4:
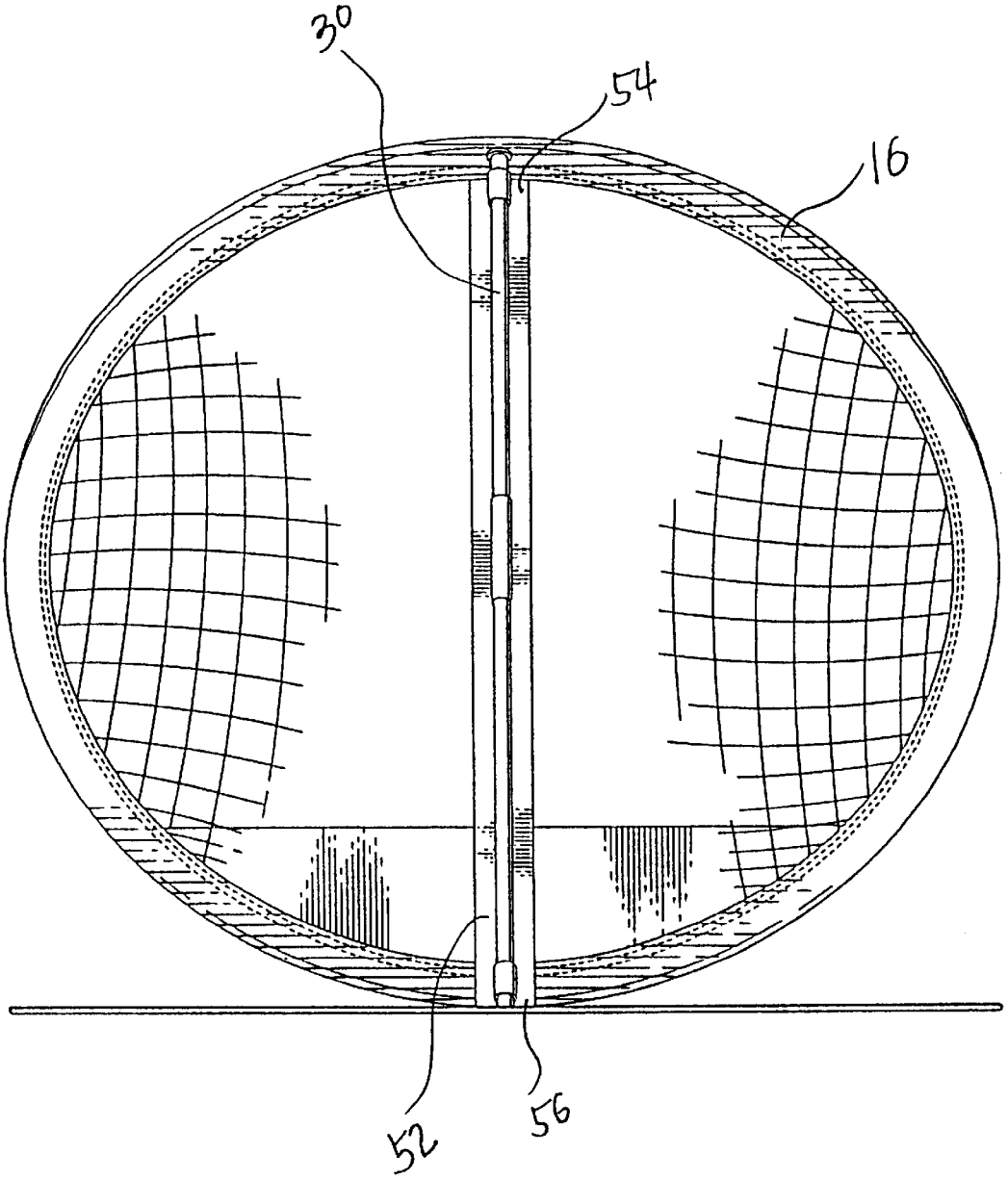
FIG. 4 is a rear view of the portable net device in FIG. 1.
Figure 5:
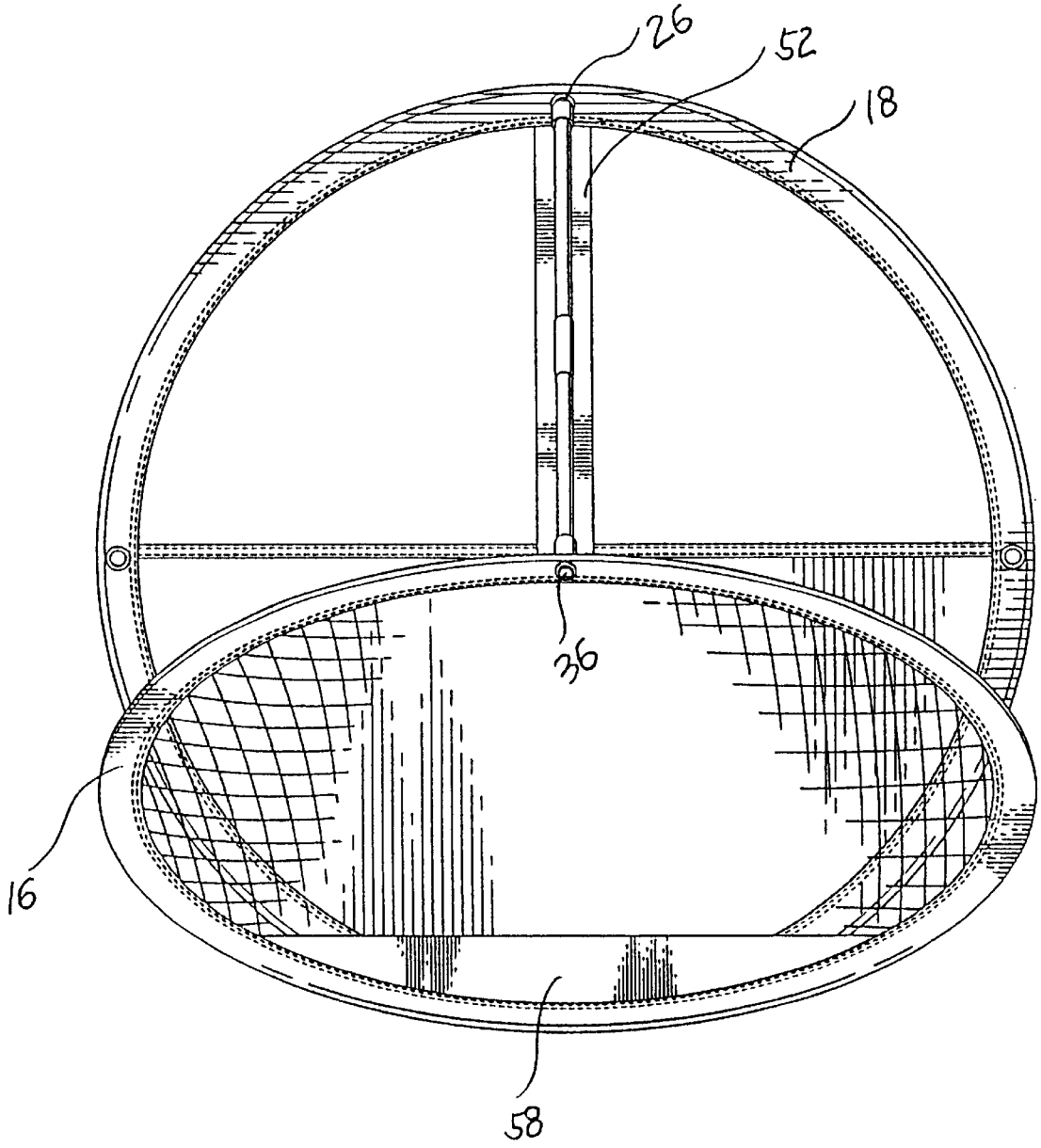
FIG. 5 is a top view of the portable net device in FIG. 1.

The portable net device 10 according to the present invention further comprises at least one strap 52 having two ends 54, 56 as shown in FIG. 4. The one end 54 is attached to the main member 12 about the top hole 19 and the other end 56 is attached to the base member 14 about the bottom hole 26.

Also, the strap 52 may longitudinally cover the support means 30. The strap 52 may be preferably formed of an elastic material.

The portable net device 10 may further have an arc support 58 substantially covering less than about one-third of the main sleeve 16 so that the projectiles stopped in the fabric portion can be maintained behind the arc support 58. Here, the arc support 58 may be formed of a fabric material such as synthetic cloth or natural cloth.

Figure 6:
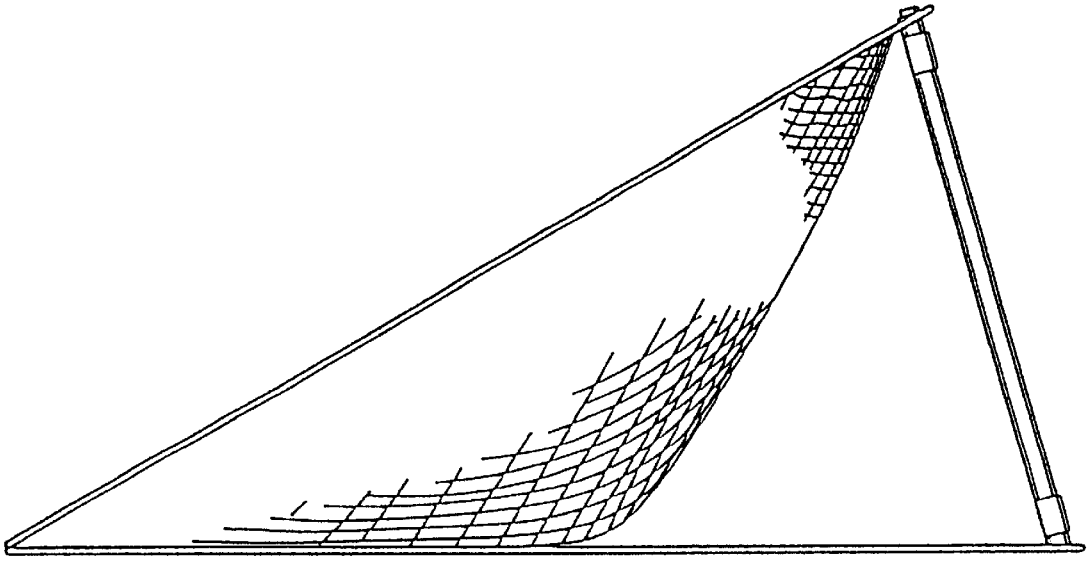
FIG. 6 is a side view illustrating another version of the first embodiment.

As further shown in FIG. 6, a preferred version of the present invention may have a unitary support means 30 which serves to lower the main member 12, wherein the first half 38 is formed unitary with the second half 40.

Figure 7:
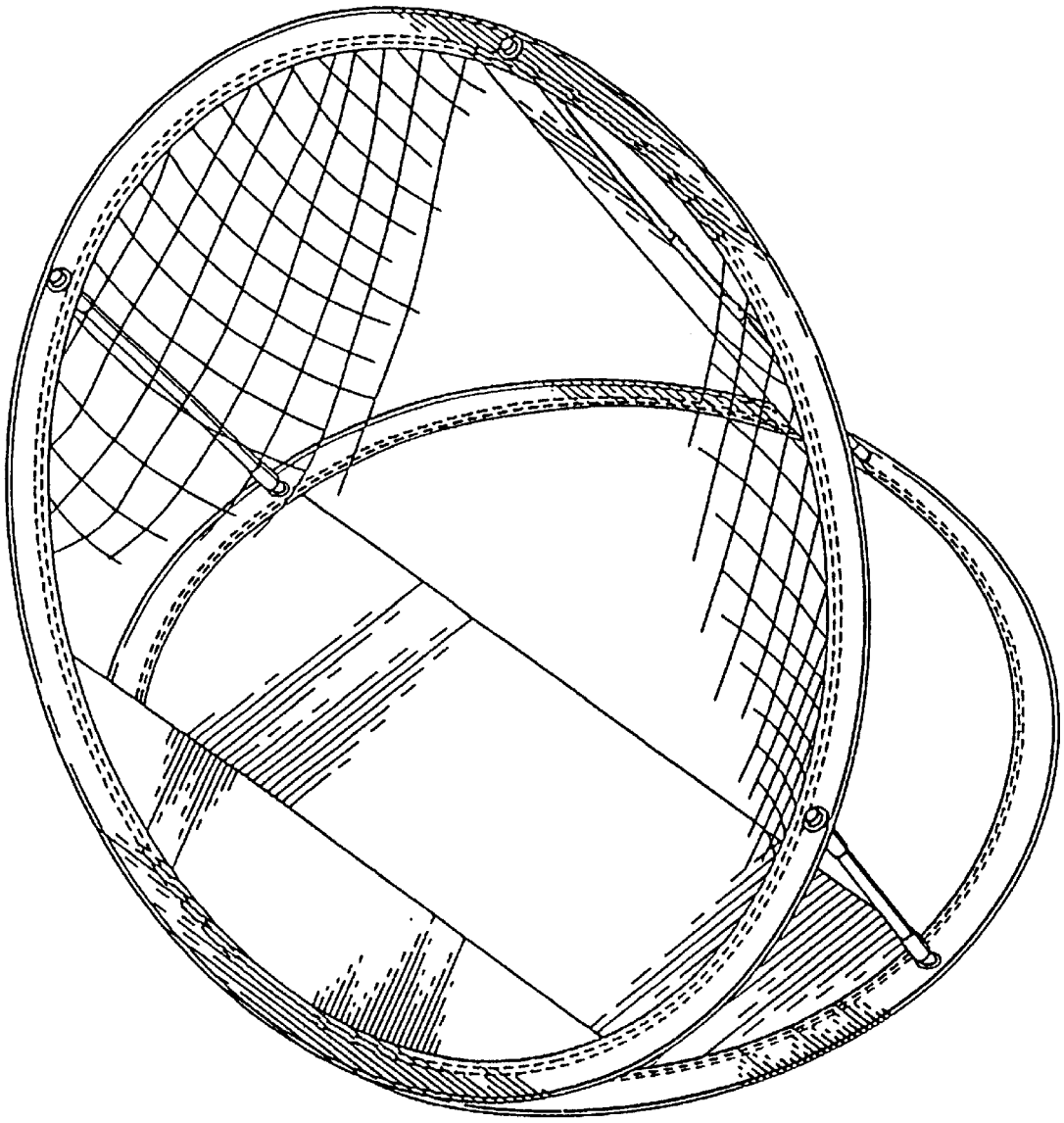
FIG. 7 is a perspective view illustrating the portable net device according to a second embodiment of the present invention.

Referring to FIG. 7, the portable net device 10 according to a second embodiment of the present invention may include more than one support means 30.

As discussed above, an overall structure of the portable net device 10 comprises a pair of coilable members 12, 14 and a support means 30. For installation of the net device 10, the net device 10 is removed from its storage bag (not shown). The net device 10 then springs into two members 12, 14 collapsed together. Next, the main member 12 is simply raised and hooked up by the support means 30.

For disassembly of the net device 10, the hooked-up support means 30 can be simply removed from the coilable members 12. Then, automatically or elastically the main member 12 becomes collapsed upon the base member 14. The removed support means 30 can be easily folded by slightly pulling the second half 40 of the support means 30 while holding the first half 38.

Also, for storage of the net device 10, the pair of collapsed coilable members 12, 14 can be twisted and coiled into a plurality of overlapping loops. Accordingly, the pair of coiled members 12, 14 and the folded support means 30 can be easily stored in the storage bag (not shown).

The advantages of the present invention are numerous. First, the portable net device according to the present invention substantially improves portability by simplifying its structure. Second, a pair of coilable members are foldably connected to each other, thereby further facilitating installation and disassembly of the net device. Third, an angle between the coilable members is easy to adjust using the support means, thereby enhancing usability.

Although the present invention has been described in considerable detail with reference to certain preferred versions thereof, other versions are possible by converting the aforementioned construction. Therefore, the scope of the invention shall not be limited by the specification specified above and the appended claims.

What is claimed is:

1. A portable net device for stopping the flight of projectiles such as golf balls comprising:

a) a coilable main member forming a first closed loop, the main member having a main outer perimeter;

b) a main sleeve substantially covering the coilable main member, wherein the main sleeve has a top hole and a main node cross-opposing the top hole;

c) a coilable base member forming a second closed loop, wherein the coilable base member is rotatably attached to the coilable main member;

d) a base sleeve substantially covering the coilable base member, wherein the base sleeve has a bottom hole and a base node cross-opposing the bottom hole, and wherein the main node of the main sleeve and the base node of the base sleeve are rotatably attached to each other;

e) a fabric portion connected to the main member adjacent to the main outer perimeter for stopping the flight of projectiles such as golf balls; and f) a support means for supporting the main member so that the main member is disposed at a substantial angle with respect to the base member, wherein the substantial angle is substantially less than ninety degrees, and wherein the top hole and the bottom hole detachably receive ends of the support means.

2. The portable net device of claim 1, wherein the support means comprises a support rod and the respective ends of the support means form an upper end removably engaged in the top hole and a lower end removably engaged in the bottom hole, wherein the upper end and the lower end of the support means respectively have a protrusion extending from each tip thereof, and wherein the protrusion is less in diameter than each of the upper and lower ends so as to stably support the main member and the base member.

3. The portable net device of claim 2, wherein the upper end and the lower end of the support means are respectively formed in a hook so as to be stably hooked into the corresponding top and bottom holes.

4. The portable net device of claim 1, wherein the support means is a first rigid support member.

5. The portable net device of claim 4 wherein the first rigid support member is disposed between the main member and the base member.

6. The portable net device of claim 5 further comprising a second rigid support member, the second rigid support member further supporting the main member.

7. The portable net device of claim 6 further comprising a third rigid support member, the third rigid support member further supporting the main member.

8. A portable net device for stopping the flight of projectiles such as golf balls comprising:

a) a coilable main member forming a first closed loop, the main member having a main outer perimeter;

b) a fabric portion connected to the main member adjacent to the main outer perimeter for stopping the flight of projectiles such as golf balls;

c) a coilable base member forming a second closed loop, wherein the coilable base member is rotatably attached to the coilable main member; and d) a support means for supporting the main member so that the main member is disposed at a substantial angle with respect to the base member, wherein the substantial angle is substantially less than ninety degrees, and wherein the support means comprises a first half, a second half, an elastic string, and a nut closure having a closed end and an open end, wherein the first half has a first inner end fixedly carried on the closed end of the nut closure and the second half has a second inner end detachably carried on the open end of the nut closure, wherein the elastic string is fixedly disposed through the first half and the second half of the support means so that the second half can be elastically disassembled from the first half of the support means.

9. The portable net device of claim 8, wherein the support means is a support rod and the respective ends of the support means form an upper end removably engaged in the top hole and a lower end removably engaged in the bottom hole, wherein the upper end and the lower end of the support means respectively have a protrusion extending from each tip thereof, and wherein the protrusion is less in diameter than each of the upper and lower ends so as to stably support the main member and the base member.

10. The portable net device of claim 9, wherein the upper end and the lower end of the support means are respectively formed in a hook so as to be stably hooked into the corresponding top and bottom holes.

11. The portable net device of claim 8, wherein the support means is a first rigid support member.

12. The portable net device of claim 11 wherein the first rigid support member is disposed between the main member and the base member.

13. The portable net device of claim 12 further comprising a second rigid support member, the second rigid support member further supporting the main member.

14. A portable net device for stopping the flight of projectiles such as golf balls comprising:

a) a coilable main member forming a first closed loop, the main member having a main outer perimeter;

b) a main sleeve substantially covering the coilable main member;

c) a coilable base member forming a second closed loop, wherein the coilable base member is rotatably attached to the coilable main member;

d) a base sleeve substantially covering the coilable base member e) a fabric portion connected to the main member adjacent to the main outer perimeter for stopping the flight of projectiles such as golf balls;

f) an arc support substantially covering less than about one-third of the main sleeve so that the projectiles stopped in the fabric portion can be maintained behind the arc support; and g) a support means for supporting the main member so that the main member is disposed at a substantial angle with respect to the base member, wherein the substantial angle is substantially less than ninety degrees.

15. The portable net device of claim 14, wherein the arc support is formed of a fabric material.

16. The portable net device of claim 14, wherein the support means is a support rod and the respective ends of the support means form an upper end removably engaged in the top hole and a lower end removably engaged in the bottom hole, wherein the upper end and the lower end of the support means respectively have a protrusion extending from each tip thereof, and wherein the protrusion is less in diameter than each of the upper and lower ends so as to stably support the main member and the base member.

17. The portable net device of claim 16, wherein the upper end and the lower end of the support means are respectively formed in a hook so as to be stably hooked into the corresponding top and bottom holes.

18. The portable net device of claim 14, wherein the support means is a first rigid support member.

19. The portable net device of claim 18 wherein the first rigid support member is disposed between the main member and the base member.

20. The portable net device of claim 19 further comprising a second rigid support member, the second rigid support member further supporting the main member.

* * * * *